United States Patent [19]

Fukuo et al.

[11] Patent Number: 4,656,991

[45] Date of Patent: Apr. 14, 1987

[54] BREATHER DEVICE FOR INTERNAL COMBUSTION ENGINE

[75] Inventors: Koichi Fukuo; Shinji Sasaki, both of Saitama, Japan

[73] Assignee: Honda Giken Kogyo Kabushiki Kaisha, Tokyo, Japan

[21] Appl. No.: 804,676

[22] Filed: Dec. 4, 1985

[30] Foreign Application Priority Data

Dec. 4, 1984 [JP] Japan ..... 59-255132
Dec. 4, 1984 [JP] Japan ..... 59-183231[U]

[51] Int. Cl.[4] ..... F02M 25/06
[52] U.S. Cl. ..... 123/572; 123/41.86
[58] Field of Search ..... 123/41.86, 55 V, 55 VE, 123/55 VS, 55 VF, 195 R, 572, 573, 574

[56] References Cited

U.S. PATENT DOCUMENTS 1,851,051 3/1932 Loeffler ..... 123/55 VE
1,916,522 7/1933 McCuen ..... 123/41.86
2,660,987 12/1953 Doughty ..... 123/41.86
2,782,775 2/1957 Leach ..... 123/41.86
2,797,674 7/1957 Dolza ..... 123/41.86
2,906,252 9/1959 Beardsley ..... 123/572
4,541,399 9/1985 Tanaka et al. ..... 123/572 X

*Primary Examiner*—Tony M. Argenbright
*Attorney, Agent, or Firm*—Lyon & Lyon

[57] ABSTRACT

A crankcase blow-by gas breather device and arrangement where the ends of the crankcase are provided with spaces beyond the end supporting walls for the crankshaft, which spaces conduct the blow-by gas directly to a breather chamber for separating at least some of the entrained oil. The breather chamber is connected to the overhead valve chambers which, in turn, are connected to the intake system for recycling the blow-by gases to the engine. In a V-type engine the breather chamber is integrally formed in the bottom wall of the "V".

14 Claims, 8 Drawing Figures

BREATHER DEVICE FOR INTERNAL COMBUSTION ENGINE

The present invention relates to a breather arrangement in an internal combustion engine and, in particular, to an arrangement in the cylinder block for conducting the blowby gases to the engine intake system with a minimum of entrained oil.

Heretofore, various arrangements and devices have been known and used for conducting the engine blowby gases to the intake while reducing the oil entrained in those gases. One such arrangement is shown in the accompanying FIG. 1A in which a blow-by gas take-out port "d" is provided in a crankcase "a" of an engine "c" which has an oil sump "b" below the crankcase "a", and wherein the blow-by gas from the crankcase "a" is recycled to an intake system "i" through the take-out port "d", valve chamber "k" and breather cap or chamber "h". In this case, the take-out port "d" is generally provided in a skirt portion "e" of a cylinder above the crankcase "a".

In such an arrangement, the blow-by gas take-out port "d" is easily influenced by pressure variations caused by rotation of a crankshaft "f" because it is provided in the skirt portion "e" and leads directly to the valve chamber "k". Further, the oil splashes from the connecting rod "g" connected to the crankshaft "f" and is apt to be conducted from the take-out port "d" through the blow-by gas passage leading to the valve chamber "k".

Another device and arrangement known and used in the prior art is disclosed in Japanese Utility Model Laid-Open Publication No. 100910/84 in which, as shown in the accompanying FIG. 1B, a V-type engine "c" is provided with a breather chamber "h", and the blow-by gas from a crankcase "a" is recycled through the chamber "h" to an intake system "i". Generally in this case, the chamber "h" is positioned above a V-bank bottom wall of the engine "c" and it communicates with the interior of the intake manifold of the intake system "i" from an upper surface of the chamber through a communication passage "j". To reach chamber "h" the blow-by gas must pass from the crankcase "a" through the passage "d" in the lower walls "e" of the cylinders and into valve chambers "k" located thereabove, from which it then passes through upper walls of the cylinders to the chamber "h" and recycled into the intake manifold. Again, with this arrangement in a V-type engine, the oil splash is carried together with the blow-by gas through the valve chambers "k" prior to being conducted into the breather chamber "h" where the oil is separated from the gas. However, this results in an increase in the amount of oil in the valve chambers "k" and requires a relatively long passage until the oil returns to the oil pan "b", so the oil level in the oil pan is lowered. Further, since the device forming chamber "h" is positioned in the V between the banks of cylinders, the upper wall of the engine and that area become complicated and congested whereby the cost of manufacture is increased and water and other material may accumulate.

It is the object of the present invention to provide a breather device which avoids the aforedescribed problems with the prior art devices and systems.

According to the present invention, such object is attained by the breather device in a V-type engine having a breather chamber to recycle blow-by gas from the crankcase to an intake system through the breather chamber in which that breather chamber is formed integrally with the underside of the V-bank bottom wall of the engine and the blow-by gas from the crankcase is first conducted through the breather chamber and then communication passages formed in the cylinder walls into the valve chambers located thereabove and recycled to the intake system.

Also, according to the present invention, the above object is achieved by providing blow-by gas take-out ports in the crankcase of the engine at each end of the engine beyond the journal walls supporting the crankshaft at each end to minimize the oil splashing effect of the crankshaft and piston rods.

Additional objects and advantages of the present invention will become apparent from the following description of a preferred embodiment thereof as illustrated in the drawings, wherein.

Figure 2:
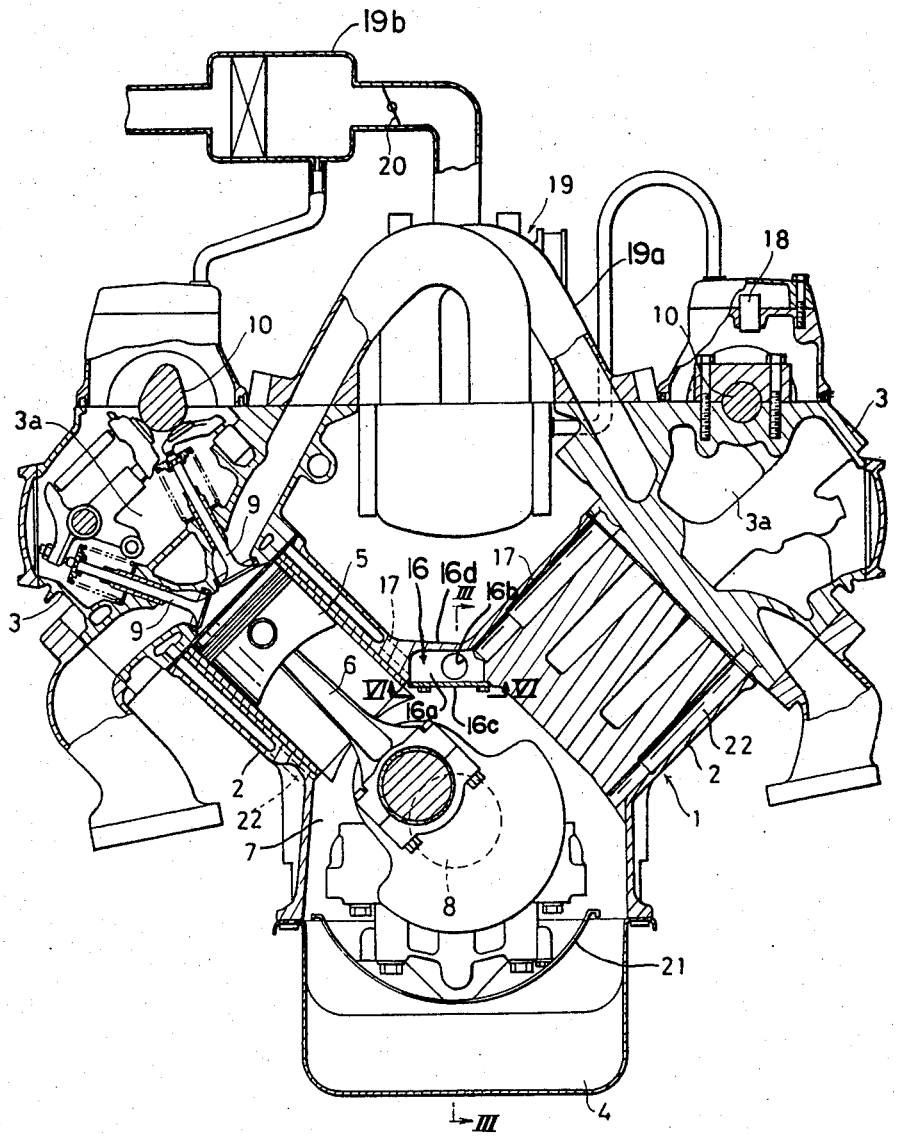
FIG. 2 is a sectional end view of a V-type engine employing the breather arrangement of the present invention.

Referring now in detail to the drawings, FIG. 2 shows an example of an application of the breather device and arrangement embodying the invention to a V-type engine 1, comprising a V-type cylinder block 2 and a pair of cylinder heads 3 mounted above the cylinder block 2. Below the cylinder block 2 is provided an oil pan to form an oil sump 4. Pistons 5 of plural cylinders in the cylinder block 2 are connected through connecting rods 6 to a crankshaft 8 mounted in a crankcase 7, and plural intake and exhaust valves 9 are mounted in each cylinder head 3. A camshaft 10 is provided for opening and closing the valves 9 similar to any OHC type engine.

Figure 1A:
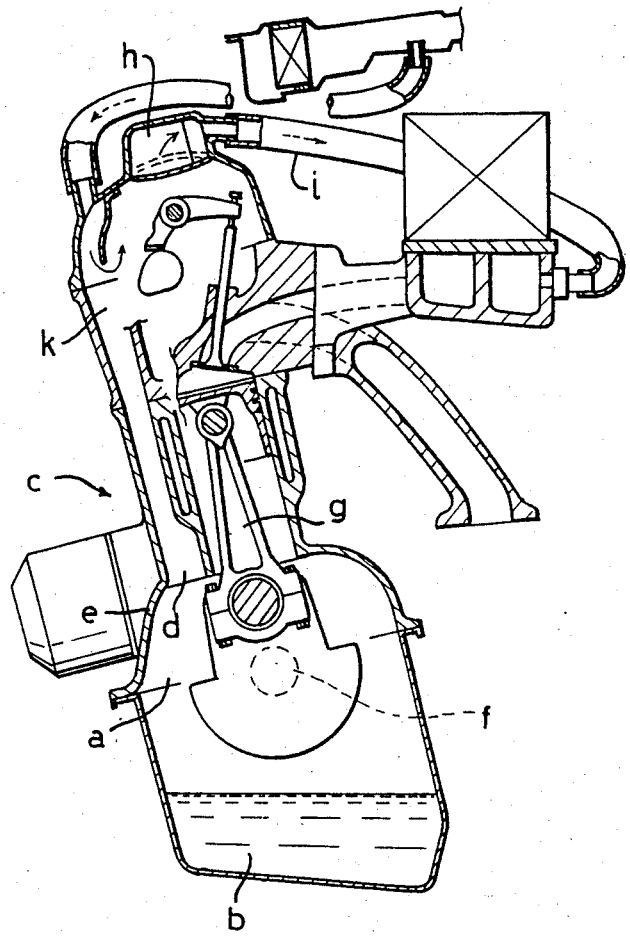
FIG. 1A. PRIOR ART
FIG. 1A is a sectional end view of a conventional crankcase breather arrangement in an in-line type internal combustion engine.
Figure 1B:
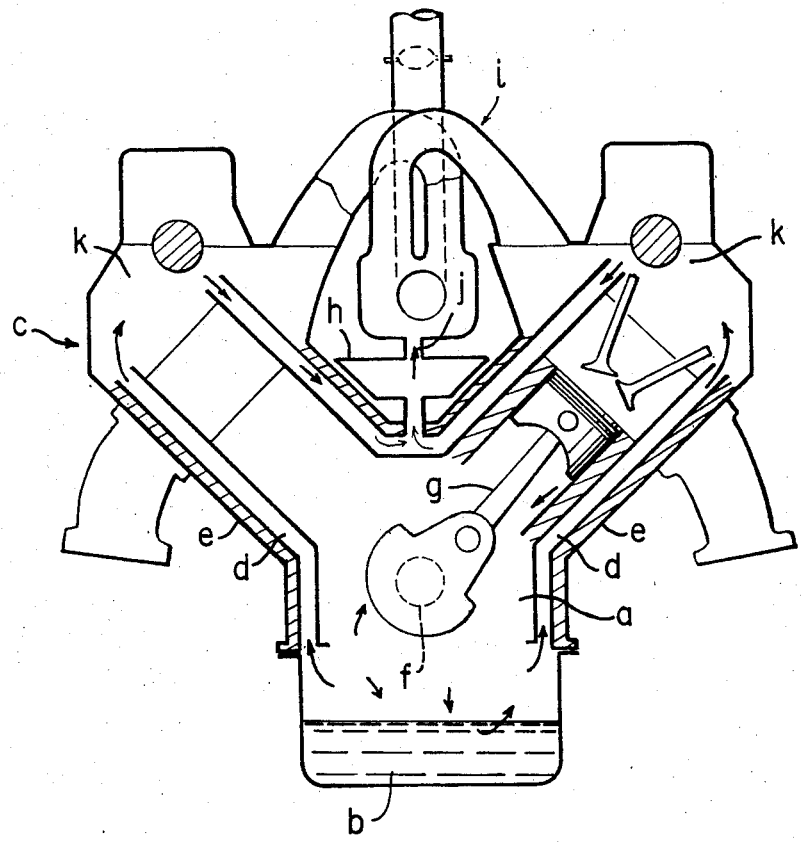
FIG. 1B. PRIOR ART
FIG. 1B is a sectional end view of a conventional crankcase breather arrangement in a V-type engine.
Figure 3:
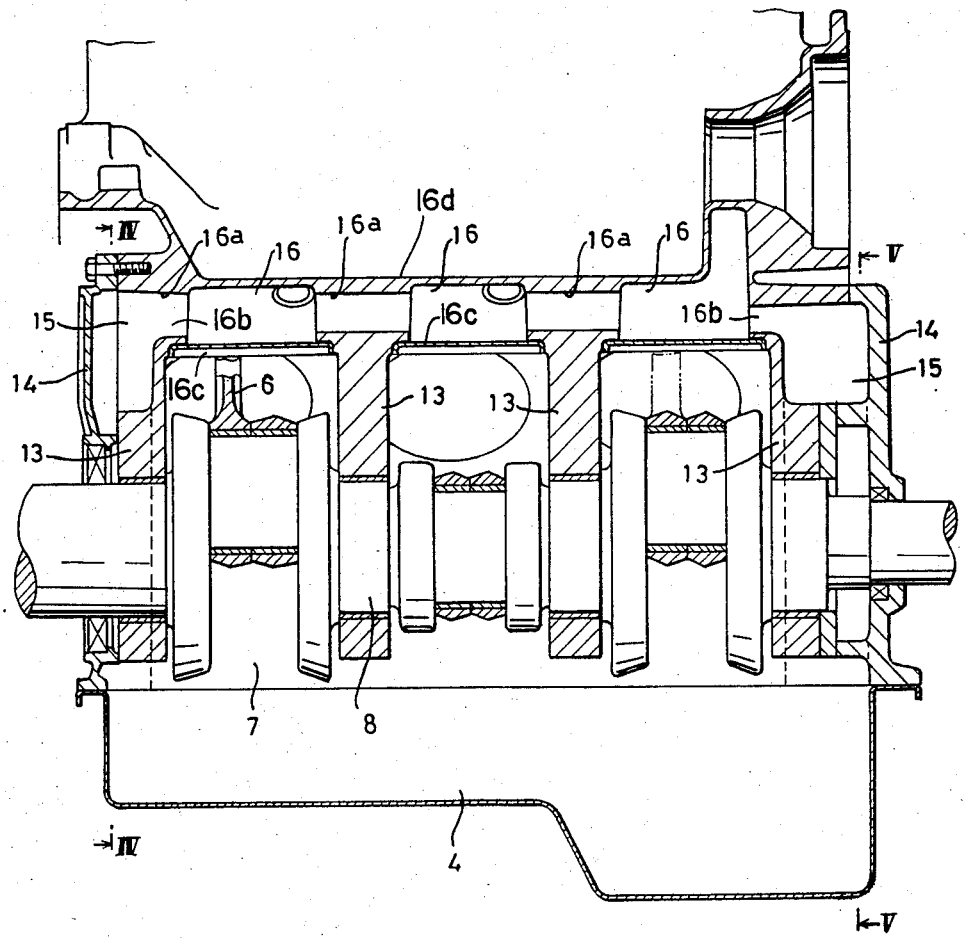
FIG. 3 is a sectional side elevation view of the engine taken substantially on the line III—III in FIG. 2.
Figure 4:
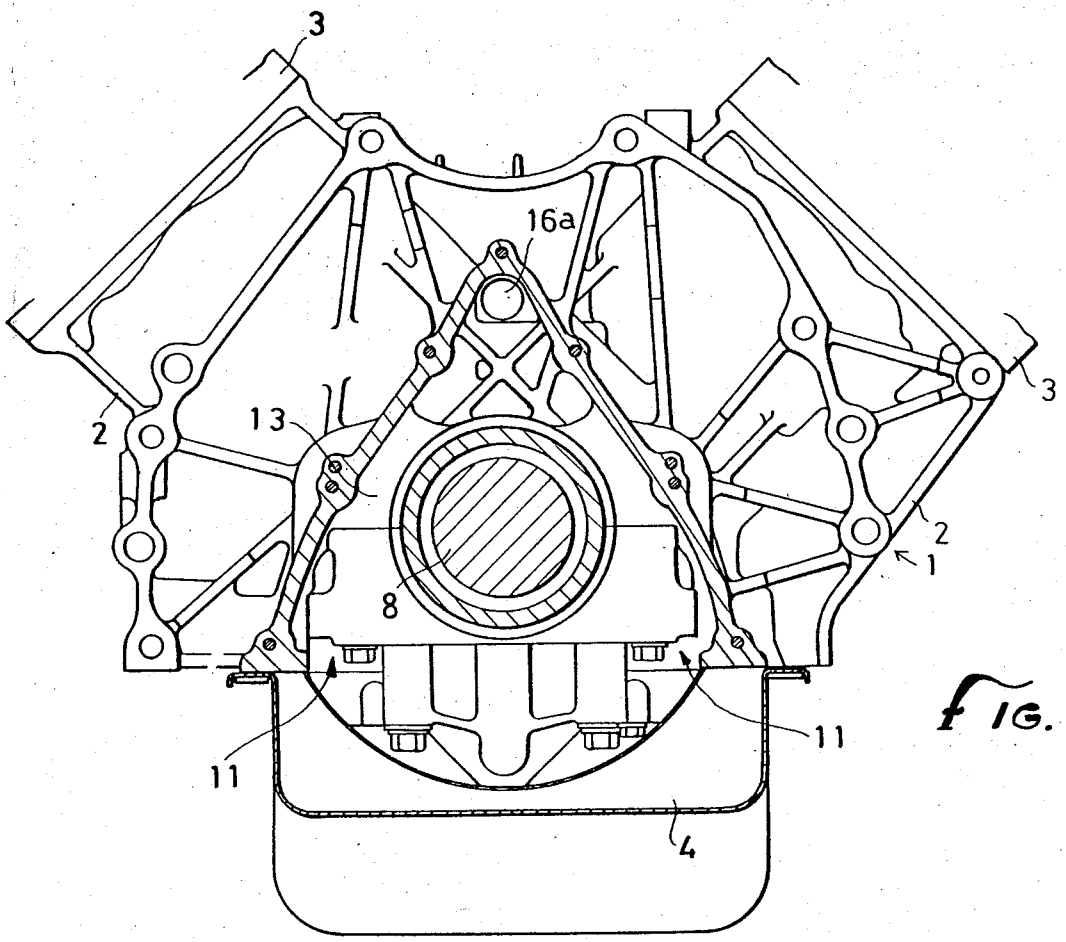
FIG. 4 is a sectional end view taken substantially on the line IV—IV in FIG. 3.
Figure 5:
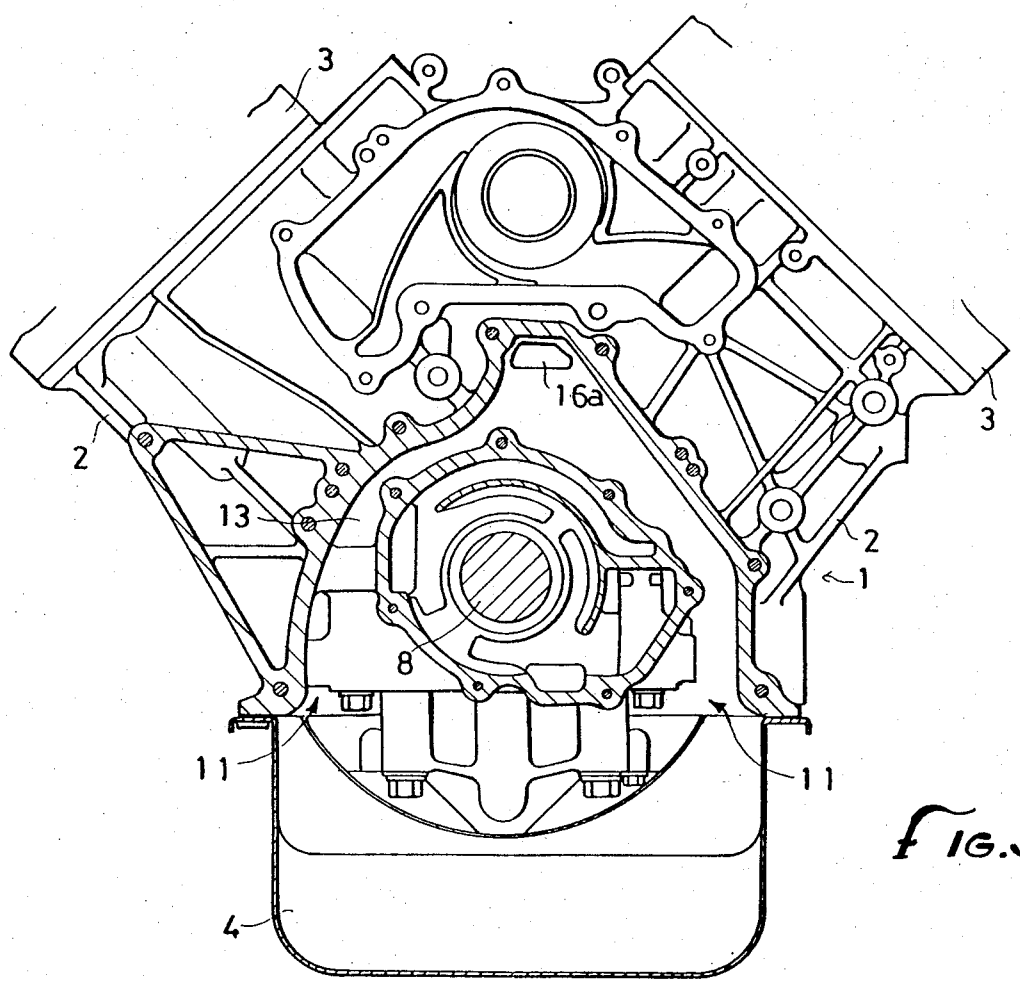
FIG. 5 is a sectional end view taken substantially on the line V—V in FIG. 3.
Figure 6:
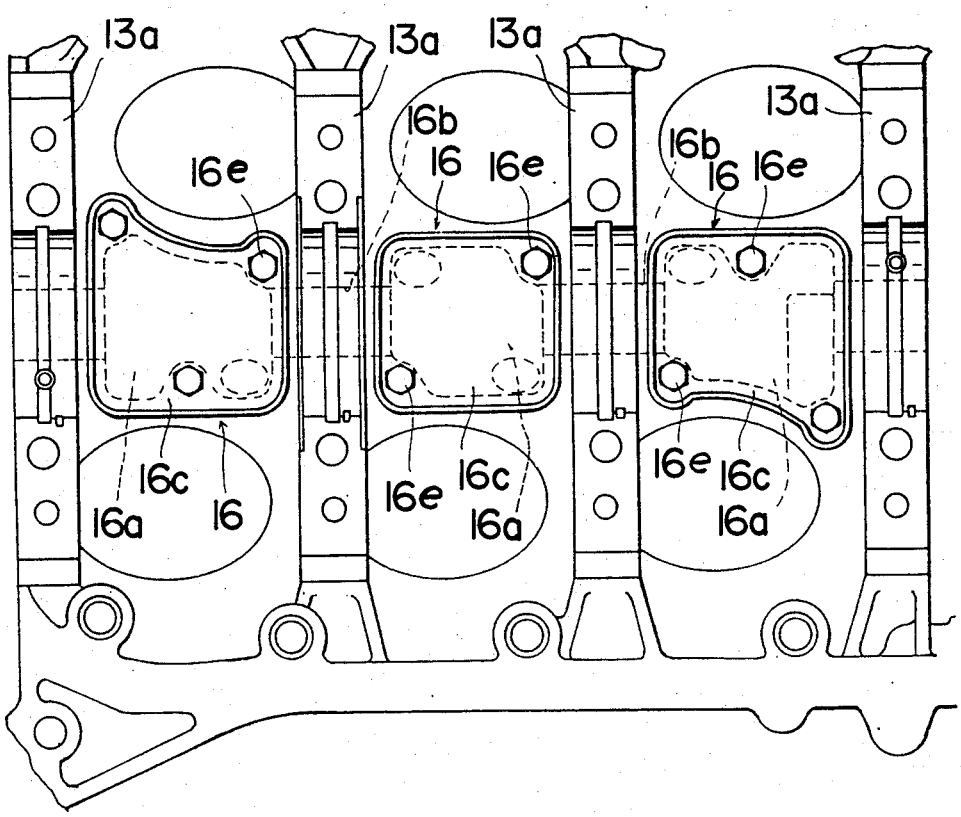
FIG. 6 is a bottom view of the inside of the engine of FIGS. 2–5 at the base of the "V" between the cylinders and taken substantially on the line VI—VI in FIG. 2.

The engine construction as thus far described is not particularly different from the conventional one shown in FIG. 1B, but according to the present invention the blowby gas handling ports, passages and arrangement are substantially different. The blow-by gas take-out ports 11 are positioned outside bearing walls 13 for the crankshaft 8 on both outside ends of the engine in the crankshaft direction in the crankcase 7. More specifically, as shown in FIGS. 3 to 5, the blow-by gas take-out ports 11 comprising lower opening ends of spaces 15 formed between outside faces of the bearing walls 13 and cover members 14 applied thereto. A breather chamber 16 is formed on the underside of the V bank bottom wall **16*d* of the cylinder block 2, and each space 15 communicates with the chamber 16 through a hole 16*b*. In V6 engine illustrated in FIG. 3, there are three small chambers 16 and each is connected to the other by a hole 16***a* extending through a bearing wall 13. Each small chamber 16 is cast in the cylinder block 2 to be completely open in the downward direction. A cover member 16*c* is mounted on the bottom of and encloses each small chamber 16. Bolts 16*e* mount the covers 16*c* to the cylinder block 2.

The breather chamber 16 communicates with a valve chamber 3*a* formed in the upper portion of each cylinder head 3 through a communication passage 17 formed in the cylinder wall of the block 2 (see FIG. 2). One of the valve chambers 3*a* communicates with an intake manifold 19*a* of the intake system 19 through a PCV valve 18, while the other valve chamber 3*a* communicates with the upstream side of a throttle valve 20 at the air cleaner 19*b*. Thus, the blow-by gas in the crankcase 7 is recycled from the take-out ports 11 to the intake system through the breather chamber 16 first and then through the valve chambers 3*a*.

Figure 7:
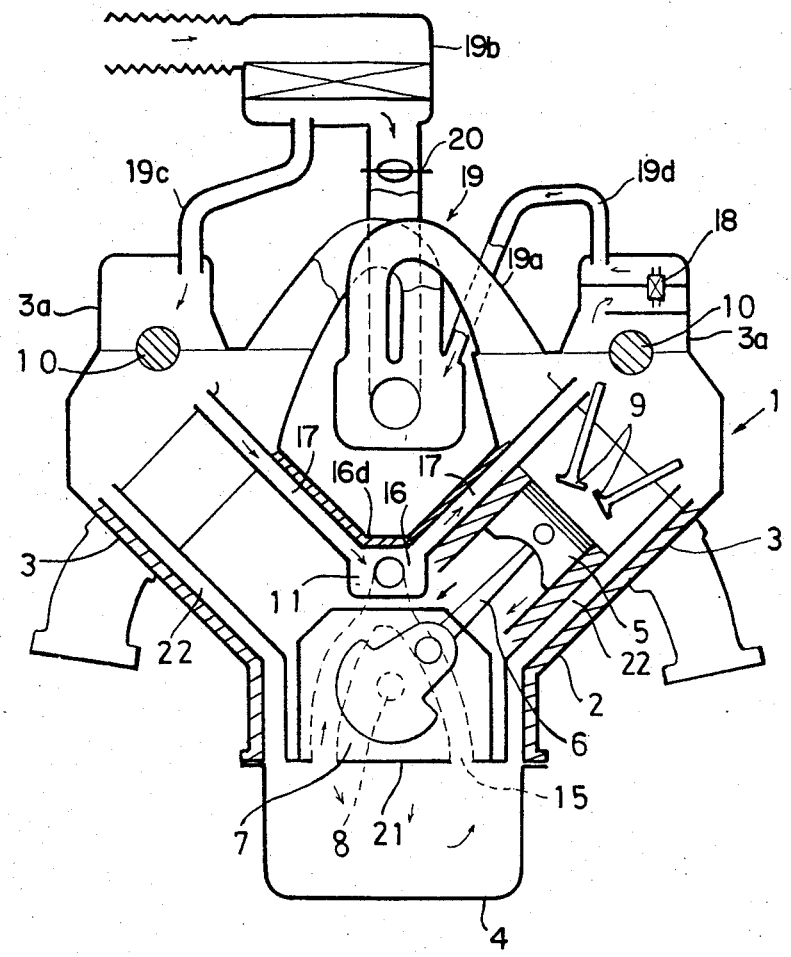
FIG. 7 is a diagrammatic sectional end view of the engine similar to FIG. 2 for illustrating the operation of the arrangement of this invention.

In this arrangement, as shown in FIG. 7, when the amount of blow-by gas from the crankcase 7 is relatively small, fresh air is introduced from the air cleaner case 19*b* into the chamber 16 through the passage 19*c* and valve chamber 3*a* (on the left in FIG. 2), then through the communication passage 17 formed in the left-hand cylinder wall, then together with the blow-by gas it passes through the communication passage 17 formed in the right-hand cylinder wall, and then through the PCV valve 18 and recycled into the intake manifold 19*a*. When the amount of blow-by gas is relatively large, the blow-by gas recycle is made from the chamber 16 through both communication passages 17 to the valve chambers 3*a* and then from the left side chamber 3*a* into the air cleaner case 12 and from the right side chamber 3*a* into the intake manifold 19*a* through the PCV valve 18.

In the drawings, the numeral 21 denotes a baffle plate disposed in the crankcase 7 for reducing the effects of oil splashing, and the numeral 22 denotes an oil return passage formed in the cylinder wall of the cylinder block 2 for returning the oil from each valve chamber 3*a* into the oil sump 4.

The operation of the present invention will now be explained on the basis of the above-described embodiment. The blow-by gas in the crankcase 7 of the engine 1 is recycled from the take-out ports 11 to the intake system through the breather chamber 16 and valve chambers 3*a*. This point is not specifically different from the prior art. However, according to conventional construction, as shown in FIGS. 1A and 1B, the take-out port "d" is provided in the skirt portion "e" of the cylinder block located above the crankcase "a", thus causing the previously described problems. On the other hand, in the present invention, the blow-by gas take-out ports 11 are formed in positions outside the bearing walls 13 at the ends of the crankshaft 8 located on both outside ends of the crankcase 7. Each bearing wall 13 acts as a shielding plate, so the blow-by gas take-out port 11 is less influenced by pressure variations and oil splashes caused by rotation of the crankshaft 8.

Moreover, even when the oil in the crankcase 7 is biased to one end of the crankshaft at the time of cornering (for a laterally mounted engine) or acceleration and deceleration (for a longitudinally mounted engine) whereby one of the blow-by gas take-out ports 11 is blocked with the oil, the other take-out port is kept open, thereby insuring the clear passage of the blow-by gas. Moreover, in the above embodiment the take-out ports 11 are formed on both sides as a pair positioned in front and in the rear in a direction perpendicular to the crankshaft 8 with the bearing portion of the bearing wall 13 therebetween, and this arrangement is advantageous because one of each pair of take-out ports 11 is kept open not only when oil is biased in the direction of the crankshaft 8 of the engine 1 but also when it is biased in a perpendicular to the crankshaft 8, such as during combined acceleration and cornering.

Thus, according to the present invention, since blow-by gas take-out ports are positioned outside the bearing walls for the crankshaft which are located on both outsides in the crankshaft direction of the crankcase, both such bearing walls act as shielding plates, so pressure variations and oil splahes caused by the rotation of the crankshaft can be prevented or minimized. Besides, even when oil is biased to one side in the crankshaft direction, one of the take-out ports on both sides is kept open and insures the recycling of blow-by gas.

Another important feature of the present invention will be apparent from a further comparison with the prior art arrangement shown in FIG. 1B wherein the blow-by gas passes through the valve chambers "k" prior to being conducted into the breather chamber "h", so that some oil is separated from the gas in the valve chamber "k", thus increasing the amount of oil in the valve chambers "k". Further, the breather chamber "h" is positioned in an inconventional location above the V bank bottom wall of the engine "c". On the other hand, in the present invention, blow-by gas is conducted from the crankcase 7 directly into the breather chamber 16, so that the oil first is separated there from the gas, that is, the amount of oil conducted into the valve chambers 3*a* decreases. Since the chamber 16 is relatively close to the oil sump 4, the oil in the chamber 16 returns to the oil sump 4 promptly, and since the chamber 16 is integrally formed under the V bank bottom wall 16*d*, the upper surface of the bottom wall 16*d* is flat for preventing the accumulation of water or the like.

What is claimed:

1. A breather device in a V-type engine for recycling blow-by gas from a crankcase to an intake system through a breather chamber, comprising said breather chamber formed integrally with an underside of a V-bank bottom wall of the engine, and passage means for conducting the blow-by gas from the crankcase through said breather chamber and then into valve chambers located thereabove for recycling into said intake system.

2. The device of claim 1 wherein said passage means include passages formed in cylinder walls of the engine extending from said breather chamber to the valve chambers.

3. The device of claim 1 wherein said passage means include spaces form at each end of the engine beyond bearing walls for supporting an engine crankshaft, said spaces opening to both the breather chamber and the crankcase.

4. The device of claim 1 wherein said passage means includes passages extending from each valve chamber to the intake system.

5. The device of claim 4 wherein said passage extending from one valve chamber is connected to an air filter housing of the intake system.

6. The device of claim 5 wherein said passage extending from the other valve chamber is connected through a PCV valve to the intake system.

7. The device of claim 1 wherein said breather chamber includes downwardly open spaces, and removable covers enclosing said spaces from the bottom.

8. A breather device in an internal combustion engine having an oil sump below a crankcase supporting a crankshaft, comprising, blow-by gas take-out ports formed in the crankcase for recycling blow-by gas from the crankcase to an intake system, and said blow-by gas take-out ports being positioned outside of end bearing walls for supporting the crankshaft.

9. The breather device of claim 8, wherein at least one of said blow-by gas take-out ports includes portions on opposite sides of the crankshaft.

10. The breather device of claim 8 wherein each said blow-by gas take-out port is comprised of a pair of passages with one passage on one side of the crankshaft and the other passage of the pair on the other side of the crankshaft.

11. The breather device of claim 8 wherein a breather chamber is provided for separating entrained oil from the blow-by gas, and means for communicating said blow-by gas take out ports directly to said breather chamber.

12. The breather device of claim 11 for a V-type engine having cylinder block with a bottom wall at base of the V, and said breather chamber integrally formed in said bottom wall.

13. The breather device of claim 11 wherein passage means are provided for conducting the blow-by gas from the breather chamber to overhead valve chamber means.

14. The breather device of claim 13 wherein means are provided for conducting the blow-by gas from said valve chamber means to the intake system of the engine.

* * * * *